US008713713B2

(12) United States Patent
Yan

(10) Patent No.: US 8,713,713 B2
(45) Date of Patent: May 6, 2014

(54) NECKTIE ASSEMBLY

(76) Inventor: Ping Yan, Beijing (CN)

( * ) Notice: Subject to any disclaimer, the term of this patent is extended or adjusted under 35 U.S.C. 154(b) by 191 days.

(21) Appl. No.: 13/131,015

(22) PCT Filed: Dec. 23, 2008

(86) PCT No.: PCT/CN2008/002050

§ 371 (c)(1),
(2), (4) Date: May 24, 2011

(87) PCT Pub. No.: WO2010/072012

PCT Pub. Date: Jul. 1, 2010

(65) Prior Publication Data

US 2011/0225702 A1 Sep. 22, 2011

(51) Int. Cl.
*A41D 25/08* (2006.01)

(52) U.S. Cl.
USPC ..... 2/152.1; 2/153; 2/145

(58) Field of Classification Search
CPC ... A41D 25/022; A41D 25/025; A41D 25/02; A41D 25/003; A41D 25/08; A41D 25/14; A41D 25/027; A41D 25/10; A41D 25/006
USPC ..... 2/152.1, 153, 149, 150, 145, 157, 151, 2/337, 341, 342
See application file for complete search history.

(56) References Cited

U.S. PATENT DOCUMENTS 159,421 A * 2/1875 Komp ..... 24/66.9
888,549 A * 5/1908 Swanson ..... 2/153
1,434,797 A * 11/1922 Shannon ..... 2/145
1,527,665 A * 2/1925 Benoit ..... 2/153
2,142,322 A * 1/1939 Martin ..... 2/153
2,180,861 A * 11/1939 Casidy ..... 2/153
2,465,947 A * 3/1949 Ve Relle ..... 2/153
2,588,576 A * 3/1952 Roop et al. ..... 2/145
2,617,108 A * 11/1952 Anzell ..... 2/153
2,749,553 A * 6/1956 Miller ..... 2/145
2,898,600 A * 8/1959 Lipes et al. ..... 2/150
3,745,614 A * 7/1973 Tsang ..... 2/148
3,780,381 A 12/1973 Najarian
3,818,546 A * 6/1974 Kicher ..... 24/66.11
4,748,692 A 6/1988 Fukushima
5,084,916 A * 2/1992 Austin ..... 2/149

(Continued)

FOREIGN PATENT DOCUMENTS

CN 2051450 U 1/1990
CN 97106848.8 8/1998

(Continued)

*Primary Examiner* — Amy Vanatta
(74) *Attorney, Agent, or Firm* — IPro, Inc.; Na Xu

(57) ABSTRACT

A necktie assembly comprises a necktie (1) and a necktie-knot ring (3), wherein an additional hanging strip (11) is sewn on the necktie (1), and the necktie-knot ring (3) is used for forming a necktie knot. The necktie-knot ring (3) comprises a necktie-knot ring cavity (33), a necktie inlet-outlet opening (34) and a string-hanging buckling hook (25), wherein the necktie-knot ring cavity (33) is surrounded by a front shell (31) and a rear shell (32) of the necktie-knot ring and is used for enclosing the necktie (1); the necktie inlet-outlet opening (34) is positioned on the rear shell (32) and the necktie can pass from its top to its bottom; the string-hanging buckling hook (25) extends from any position at one side of the necktie inlet-outlet opening (34) to the other side thereof.

6 Claims, 6 Drawing Sheets

(56) References Cited

U.S. PATENT DOCUMENTS

| | | | | |
|---|---|---|---|---|
| 5,216,757 | A * | 6/1993 | Dorkin | 2/152.1 |
| 5,361,413 | A | 11/1994 | Schaefer | |
| 5,953,755 | A * | 9/1999 | Barylski | 2/148 |
| 6,467,094 | B1 * | 10/2002 | Najarian | 2/152.1 |
| 2002/0157166 | A1 * | 10/2002 | Welch | 2/152.1 |

FOREIGN PATENT DOCUMENTS

| | | | |
|---|---|---|---|
| CN | 1104858 | C | 4/2003 |
| CN | 1440701 | A | 9/2003 |
| CN | 02144239.8 | | 9/2003 |

* cited by examiner

NECKTIE ASSEMBLY

TECHNOLOGY FIELD

The invention relates to an ornamental apparel of human clothes, particularly to a necktie and necktie-knot device matched with shirts and western-style suites.

BACKGROUND

The origin of the necktie is uncertain, but it has just four hundred years of history according to historical records. The large influences and effects of the necktie on life styles, aesthetic psychology and industrial economics are self-evident.

Perhaps, however, as it is so perfectly developed, at present there have been no more changes except those changes related to tying methods, fabrics and pattern designs.

The necktie, just like a symbol, displaying formality, steadiness and social classes, is generally used in ornamental ways and for pairing with the western-style suits usually in formal occasions.

The necktie is a long strip with a wide head end and a narrower tail end, which is formed by fabric cutting. When in use, the necktie is tied below a shirt collar to form a knot at a neckline, with the head end of the necktie hanging upon the chest. But for many people tying the necktie is quite troublesome for it is time and labor consuming, and a necktie that is not tied well may influence the personal image. In order to solve the problems, people developed many knot tying free neckties and/or devices.

The published document of the Chinese patent CN1440701A discloses a necktie knot supporting assembly for supporting a pre-tied knot, and the assembly comprises a spring clip and a main element, wherein the spring clip is used for interlocking collars of a shirt; the main element is made into a certain shape to determine the shape of the necktie knot. The said main element is provided with a vertical central wall as well as a first wing and a second wing outwards extending from the central wall. The said central wall is provided with an inserting-slot arm, and the inserting-slot arm extends to pass through the central wall and is used for being mutually engaged with the said spring clip and holding the spring clip; the central wall is provided with a notch, which is positioned such that a shirt button on the shirt collar is placed in the notch when the spring clip is engaged onto the shirt collar. Another notch is arranged in the front part of the central wall so that it is convenient for the spring clip to be connected with the main element at a large enough angle. The necktie knot supporting assembly enables the necktie knot to be more balanced and avoids the sag of the necktie knot, but its structure is complicated and pre-tie of the necktie knot is still required.

The published document of the Chinese patent CN1104858C discloses a necktie knot supporting body which can support a knot-free necktie knot to form and which can integrate a necktie structure. The supporting body is formed by sleeving a shell and a back wing, wherein the shell is in the shape of an inverted triangle with two concave waists from a front view and in the shape of an arch from a top view. A protecting beam, resistance shoulders and a protecting sheet are arranged at the inner side of the shell, and the back wing is sleeved at the inner side of the shell, and two slightly elastic lateral wings are lightly pressed on the two resistance shoulders. When in installation and arrangement, firstly both ends of a woven belt rewound into a sleeve belt downwards and pass from beneath the protecting sheet outward, from the position below the protecting beam through the resistance shoulders. Next a half section of the outer strip of a traditional necktie is tied around the supporting body to be knotted to become a perfect knot-free necktie. The necktie knot supporting body has complicated structures, and the sleeve strip is firstly formed and then tied around the supporting body to be knotted, so that it is still time and labor consuming.

SUMMARY OF INVENTION CONTENT

The invention aims to provide a necktie and necktie-knot device not requiring manual tying. It not only enables the rapid integration of necktie and necktie knot device, but also presents an unprecedented luxurious, noble and fashionable effects and qualities.

According to the first aspect, the necktie and necktie-knot device of the invention comprises:

a necktie wherein an additional string-hanging strip is installed on the necktie;

and a necktie-knot ring for forming the said necktie, Wherein the necktie-knot ring further comprises:

a necktie-knot ring cavity which is surrounded by the front shell and the rear shell of the necktie-knot ring, a necktie inlet-outlet opening which is positioned on a rear shell and the necktie can pass from its top to its bottom, and a string-hanging buckling hook which extends from any position at one side of the necktie inlet-outlet opening to the other side thereof.

The said string-hanging buckling hook is a thin flat object, and the bases at both sides are respectively provided with a buckle-hanging slot.

Crinkle dividing teeth for forming double-peak crinkles of the necktie are arranged on an inner side wall of the front shell.

The additional string-hanging strip is sewn in segments on the back of the necktie to form a plurality of hanging belts for inserting the string-hanging buckling hook; and a shirt-tie connecting strip is arranged at the lower end of the middle part of the necktie, and the shirt-tie connecting strip is sewn on the back or the middle seam of the necktie and is provided with a plurality of button holes.

According to the second aspect, the necktie and necktie-knot device of the invention comprises:

a necktie;

and a necktie-knot ring, wherein the necktie-knot ring is used for forming the necktie and comprises:

a necktie-knot ring cavity, wherein the necktie-knot ring cavity is surrounded by the front shell and the rear shell of the necktie-knot ring and is used for enclosing the necktie;

a necktie inlet-outlet opening, wherein the necktie inlet-outlet opening is positioned on the rear shell and the necktie can pass from its top to its bottom; and necktie fixing devices, wherein the necktie fixing devices are installed on the rear shell.

The aforementioned fixing device comprises a through slot which opens on the rear shell and a sliding buckle which is installed on the through slot.

Crinkle dividing teeth for forming the double-peak crinkles of the necktie are arranged on the inner side wall of the said front shell.

A shirt-tie connecting strip is arranged at the lower end of the middle part of the said necktie, the shirt-tie connecting strip is sewn on the back or the middle seam of the necktie and is provided with a plurality of button holes, and the shirt-tie connecting strip can pass through a trademark ring on the necktie.

According to the third aspect, the necktie and necktie-knot device of the invention comprises:

a bowknot necktie, which is provided with a bowknot and a bowknot necktie; and a bowknot necktie-knot ring which further comprises:

a necktie-knot ring cavity, wherein the necktie-knot ring cavity is surrounded by a front shell, an rear shell, a upper shell and a lower shell of the necktie-knot ring and is used for enclosing the bowknot;

a bowknot-necktie inlet-outlet opening, wherein the bowknot-necktie inlet-outlet opening is positioned on the rear shell; and a string-hanging buckling hook, wherein the string-hanging buckling hook is fixed connected with the rear shell and is used for adjusting and fixing the length of the bowknot necktie.

The aforementioned necktie-knot device also comprises: positioning teeth respectively fixed on the inner wall of the upper shell and/or on the inner wall of the lower shell.

The invention has the following technical effects:

1) the necktie can be easily tied without tying a knot;

2) by utilizing the necktie and necktie-knot device of the invention, a person who can not tie a bowknot also can rapidly tie a necktie with a regular necktie knot, without letting one feel any necktie-knot sag.

3) the necktie-knot device is made of a material different from that of the necktie, so that the necktie and the necktie knot are integrated and unified with their comparison, contrast and echoing;

4) High valued jewelry decorations can be inlaid on the front of the necktie-knot device to show nobleness and taste of a wearer;

5) the necktie can be close to the shirt at all times to prevent the necktie from flapping around to influence the beauty.

The invention will further be described in detail in accordance with the figures.

DETAILED DESCRIPTION

The necktie of the utility model refers to apparel neckties, which comprises: neckties in various shapes that match with western-style suits and shirts, cravats and scarfs. The neckties of the utility model is divided into three parts according to the state during wearing, wherein the part positioned on the front body is called a front part, the part tied around a shirt collar is called a middle part, and the part covered and shielded by the front part is called a rear part.

For the convenience of description, the following discloses a strip-type necktie with a wide head end and a narrow tail end to explain and illustrate the necktie and necktie-knot device of the utility model, but the necktie of the utility model also should comprise neckties in other shapes, cravats and scarfs.

Figure 1:
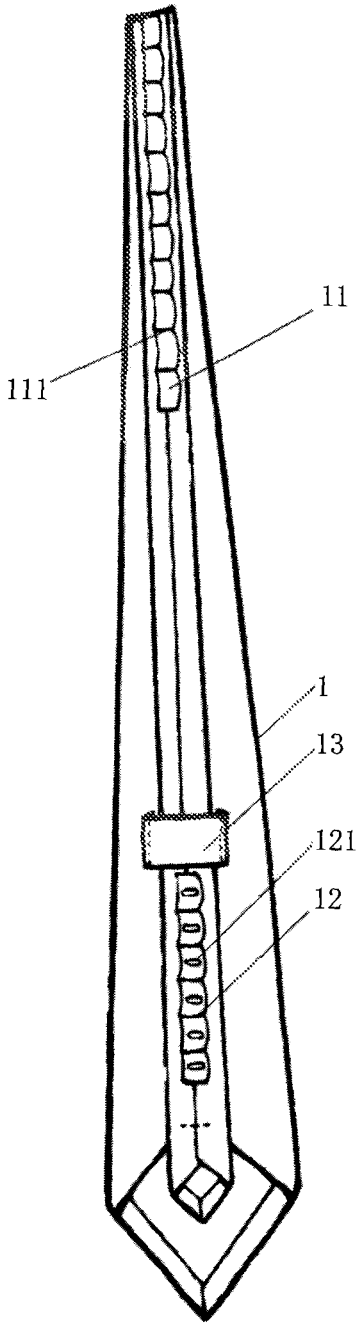
FIG. 1 is the schematic diagram of the necktie of the invention.

The bowknot necktie of the utility model is only used for tying a bowknot instead of being used as an apparel element. FIG. 1 shows the structure of the necktie of the invention, wherein the necktie is a long strip shape necktie 1 with a wide head end and a narrow tail end, and wherein an additional string-hanging strip 11 is installed or sewn on the back thereof and is generally sewn on the narrow neck tying part of the necktie. The additional string-hanging strip 11 is sewn in segments on the back of the necktie to form a plurality of hanging belts for inserting a string-hanging buckling hook 25 to be illustrated below. In detail, the additional string-hanging strip 11 is formed by sewing a strip of cloth or fabric into segments on the back of the necktie with one or more sewing thread 111, and each segment thereof forms a hanging belt (i.e. an inserted part) for inserting the string-hanging buckling hook 25 so as to form a string of wavy woven belt on the back of the necktie.

In addition, a shirt-tie connecting strip 12 is arranged on the narrow tie part of the necktie 1, and the shirt-tie connecting strip 12 is sewn on the back of the necktie and provided with a plurality of buttonholes 121 for tying shirt buttons. A trademark ring 13 allowing insertion of the narrow part of the necktie can also be arranged on the necktie 1.

Figure 2A:
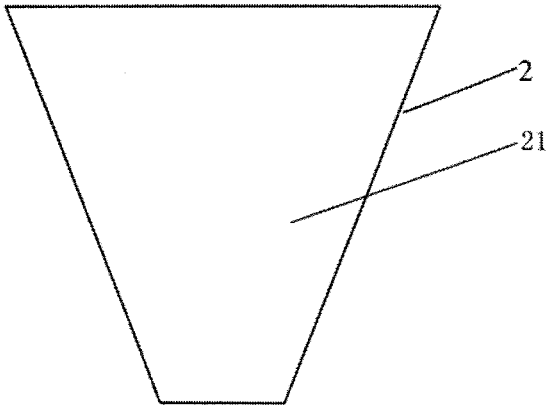
FIG. 2*a* is the front view of the first embodiment of the necktie-knot device of the invention.
Figure 2B:
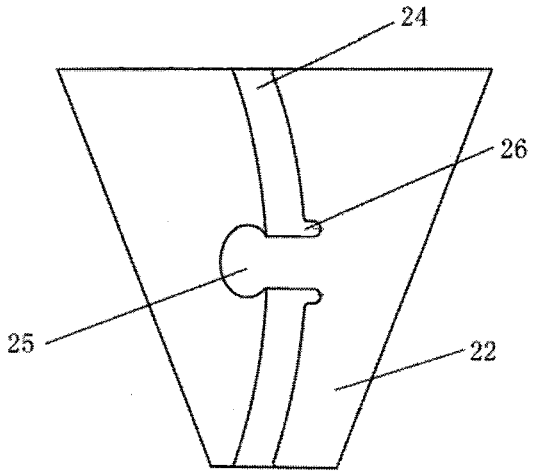
FIG. 2*b* is the rear view of the first embodiment of the necktie-knot device of the invention.
Figure 2C:
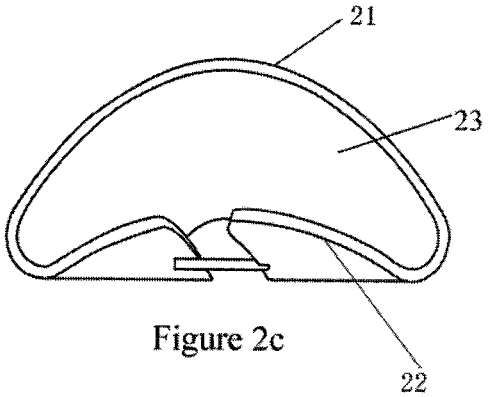
FIG. 2*c* is the schematic diagram of the first embodiment of the necktie-knot device viewed from the lateral upper part.
Figure 2D:
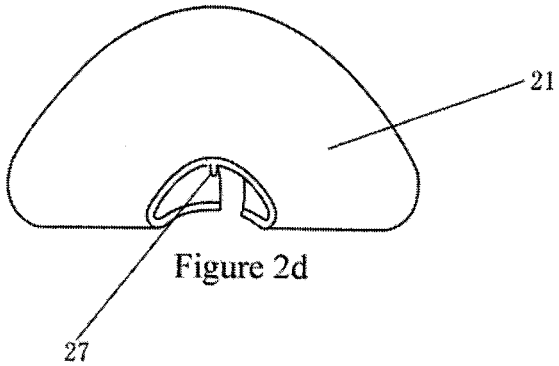
FIG. 2*d* is the schematic diagram of the first embodiment of the necktie-knot device viewed from the lateral lower part.

FIG. 2*a* to FIG. 2*d* show the structure of the first embodiment of the necktie-knot device of the invention, and the necktie-knot device is a necktie-knot ring 2 with a wide upper part and a narrow lower part (the shape can also be changed at will according to any design and usage requirements). The necktie-knot device comprises:

a necktie-knot ring cavity 23 formed by a front shell 21 and a rear shell 22, for enclosing the necktie as shown in FIG. 2*c;* a necktie inlet-outlet opening 24 from its top to its bottom of the rear shell 22; and a string-hanging buckling hook 25 which allows the said necktie extending from any position at one side of the necktie inlet-outlet opening 24 to the other side thereof.

The string-hanging buckling hook 25 is a thin flat object, which can be inserted into the hanging belt of the additional string-hanging strip 11 of the necktie. On one hand, it is used for fixing the necktie 1, and on the other hand, it can be used for regulating the tightness of the necktie. In addition, a buckle-hanging slot 26 can also be respectively arranged at the base at both sides of the string-hanging buckling hook 25 to improve the flexibility of the string-hanging buckling hook 25.

The front shell 21 of the necktie-knot ring are backwards concave at its two waists, and is forwards convex in the middle, so that it has the effect of the necktie knot. The outer surface of the front shell 21 can have screen printing, relief, and inlaid with jewels or diamonds. Hollowed-out patterns can be woven and engraved on the front shell 21.

In order to form regular, beautiful and fashionable double-peak crinkles below the necktie knot of the necktie, crinkle dividing teeth 27 for forming the double-peak crinkles of the necktie can be arranged on the inner side wall of the front shell 21.

Figure 5A:
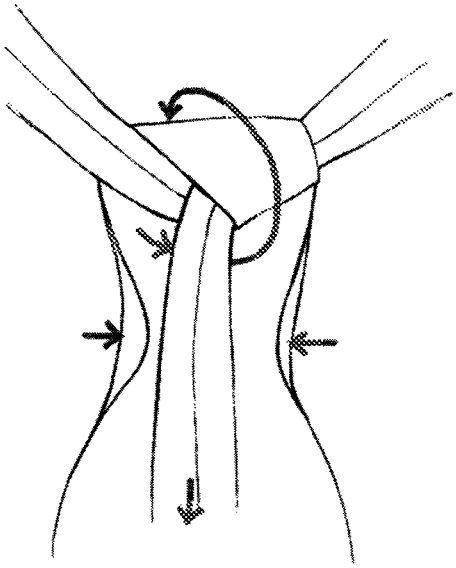
FIG. 5*a* is the first usage schematic diagram 1 of the necktie and necktie-knot device of the invention.
Figure 5B:
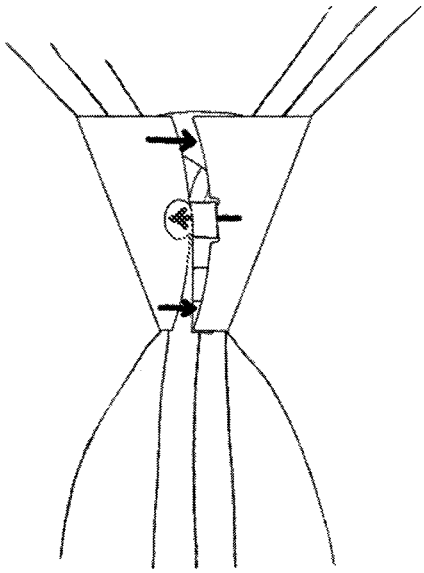
FIG. 5*b* is the first usage schematic diagram 2 of the necktie and necktie-knot device of the invention.

The necktie-knot device is applicable to the necktie 1, and FIG. 5*a* and FIG. 5*b* show the method for using the necktie and necktie-knot device, which comprises the following steps:

1. Wrap the wide end of the necktie around the narrow end for one circle, as shown in FIG. 5*a;*

2. Then insert the necktie into the necktie-knot ring cavity 23, as shown in FIG. 5*b;*

3. Adjust the length according to a perimeter of the collar, as shown in FIG. 5*b;*

4. Insert the string-hanging buckling hook into the hanging belt of the additional string-hanging strip, as shown in FIG. 5*b.*

Figure 6:
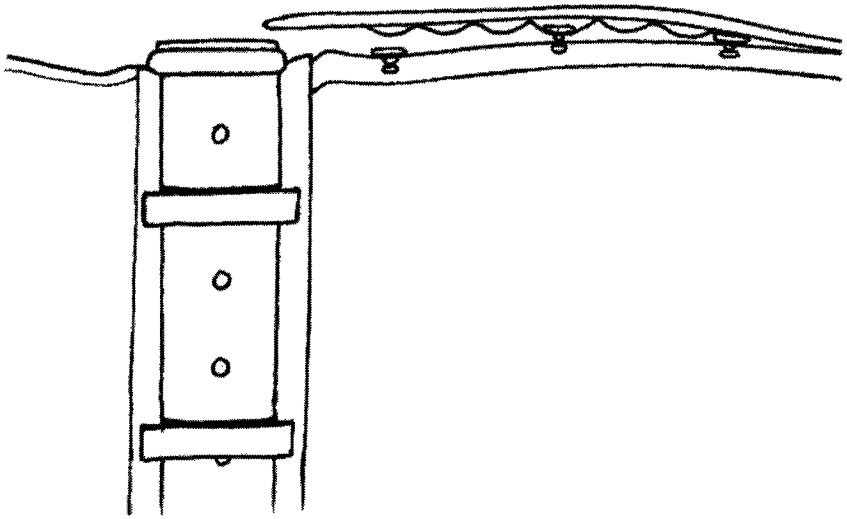
FIG. 6 is the schematic diagram for showing the service state of the shirt-tie connecting strip of the necktie of the invention.

FIG. 6 shows another method for using the necktie and necktie-knot device, which differs from the method as shown in FIG. 5*a* and FIG. 5*b* only in that both ends of the necktie are simply superimposed as opposed to wrapping the wide end of the necktie around the narrow end for one circle.

Thus, it can be seen that the necktie and necktie-knot device of the invention can enable people to rapidly and nicely tie the necktie, and the additional inlaid with jewels or diamonds in the front shell 21 may show nobleness and taste of a wearer.

Figure 5C:
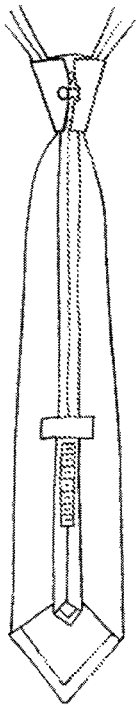
FIG. 5*c* is the other usage schematic diagram of the necktie and necktie-knot device of the invention.

In addition, as shown in FIG. 5*c*, the narrow-belt part of the necktie with the shirt-tie connecting strip 12 can also pass through the trademark ring 13 to be tied and buckled with a shirt button (as shown in FIG. 6), and thus, the pendulum at the lower half part of the necktie can be stable, avoiding deflection, moving or flapping. Compared with a traditional necktie clip and necktie, the shirt button of the invention is tied and buckled in a more convenient, concealed and economic way.

Figure 3A:
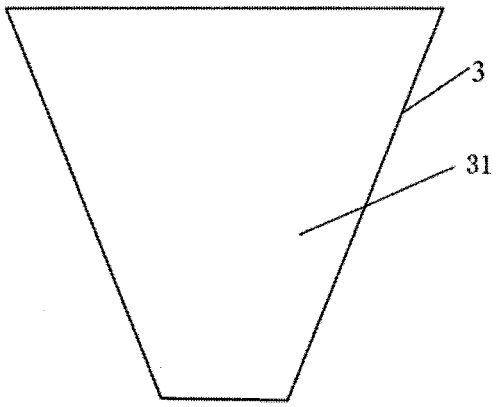
FIG. 3*a* is the front view of the second embodiment of the necktie-knot device of the invention.
Figure 3B:
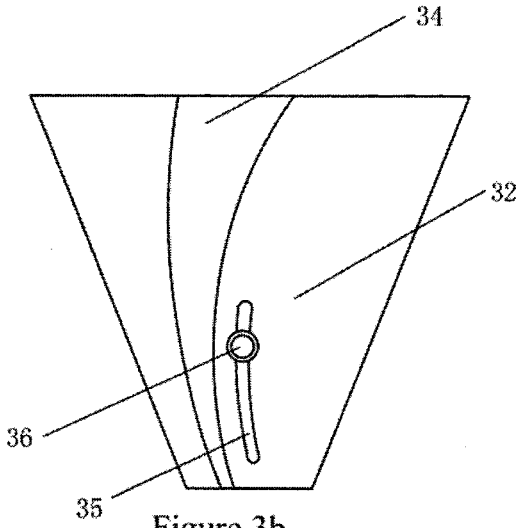
FIG. 3*b* is the rear view of the second embodiment of the necktie-knot device of the invention.
Figure 3C:
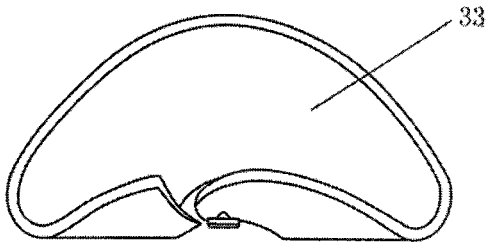
FIG. 3*c* is the schematic diagram of the second embodiment of the necktie-knot device viewed from the lateral upper part.
Figure 3D:
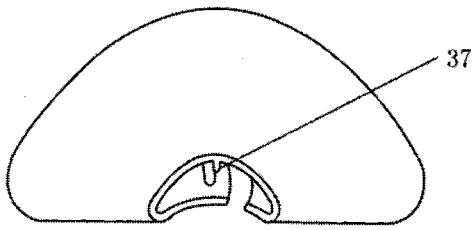
FIG. 3*d* is the schematic diagram of the second embodiment of the necktie-knot device viewed from the lateral lower part.

FIG. 3*a* to FIG. 3*d* show the structure of the second embodiment of the necktie-knot device of the invention. The necktie-knot device is a necktie-knot ring 3 (the shape can also be changed at will according to any designs and usage requirements) with a wide upper part and a narrow lower part, and the necktie-knot device comprises:

a necktie-knot ring cavity 33, which is surrounded by a front shell 31 and a rear shell 32 for enclosing the necktie, as shown in FIG. 3*c;* a necktie inlet-outlet opening 34, which is positioned on the rear shell and the necktie can pass from its top to its bottom, as shown in FIG. 3*b*; and necktie fixing devices 35 and 36, which are installed on the rear shell 32, as shown in FIG. 3*b.*

As shown in FIG. 3*b*, the fixing device comprises: a through slot 35 which opens on the real shell 32 and a sliding buckle 36 which is installed on the through slot 35. The sliding buckle 36 can slide upwards and downwards in the through slot 35 and is used for clamping the necktie plugged in the necktie-knot ring cavity 33. Because the necktie-knot ring cavity 33 is wide at the upper part and narrow at the lower part, when the sliding buckle moves downwards, the necktie plugged in the necktie-knot ring cavity 33 can be clamped.

The front shell 31 of the necktie-knot ring 3 is also backwards concave at the two waists and forwards convex in the middle. Moreover, crinkle dividing teeth 37 for forming the double-peak crinkles of the necktie are arranged on an inner side wall of the front shell 31.

The narrow-belt part of the necktie applicable to the necktie-knot ring 3 can also be provided with a shirt-tie connecting strip 12. The shirt-tie connecting strip 12 is sewn on the back of the necktie and is provided with a plurality of buttonholes 121. The shirt-tie connecting strip 12 can pass through a trademark ring 13 on the necktie. However, the necktie does not need to be provided with an additional string-hanging strip 11.

The front of the necktie-knot ring 3 is the most important area for effects, and has options of effects from simple screen printing, hollowing, intertwining and relief to inlaid of precious jewels and diamonds. The rear shell 32, which forms the back of the necktie-knot ring, has a smooth arc line taken considerations from engineering science of human bodies to offer comfort and attractiveness.

Figure 4A:
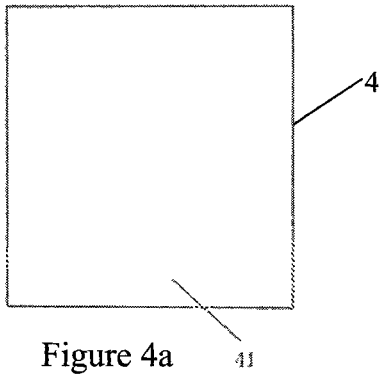
FIG. 4*a* is the front view of the second embodiment of the necktie-knot device of the invention.
Figure 4B:
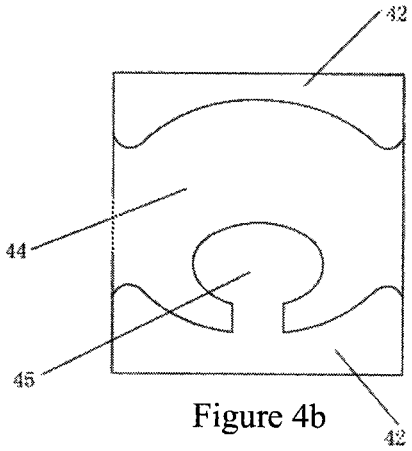
FIG. 4*b* is the rear view of the second embodiment of the necktie-knot device of the invention.
Figure 4C:
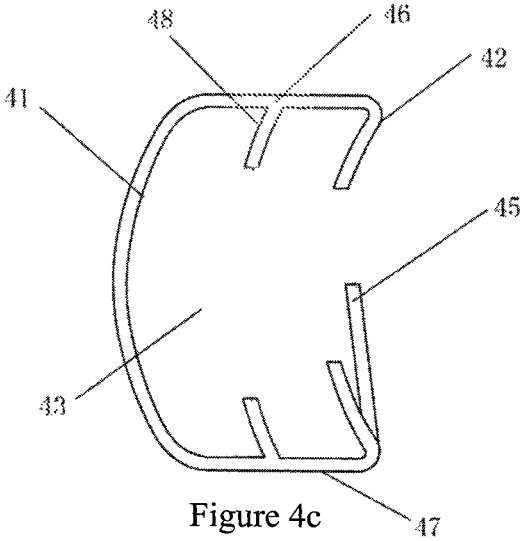
FIG. 4*c* is the side view of the second embodiment of the necktie-knot device of the invention.

FIG. 4*a* to FIG. 4*c* show the third embodiment of the necktie-knot device of the invention. The necktie-knot device is a bowknot necktie-knot ring 4 for a bowknot necktie and it comprises:

a necktie-knot ring cavity 43, wherein the necktie-knot ring cavity 43 is surrounded by a front shell 41, a rear shell 42, an upper shell 46 and a lower shell 47 of the necktie-knot ring and is used for enclosing a bowknot as shown in FIG. 4*c* (the side view);

a bowknot necktie inlet-outlet opening 44, wherein the bowknot necktie inlet-outlet opening is positioned on the rear shell 42, as shown in FIG. 4*b* and FIG. 4*c*; and a string-hanging buckling hook 45, wherein the string-hanging buckling hook is fixed connected with the rear shell 42 and is used for adjusting and fixing the length of the bowknot necktie, and which also has the effect of pressing the bowknot.

The string-hanging buckling hook 45 can also be one part of the rear shell 42, and extends upwards from the lower part of the rear shell 42.

The bowknot necktie-knot ring 4 also comprises: positioning teeth 48, wherein the positioning teeth 48 are respectively fixed on an inner wall of the upper shell 46 and/or on an inner wall of the lower shell 47, and wherein the positioning teeth 48 is used for positioning the bowknot plugged in the necktie-knot ring cavity 43.

The front shell 41 is preferably an outwardly protruded arc-shaped shell.

The back of the bowknot necktie (not shown) should be provided with holes for adjusting the length of the necktie so as to be convenient for inserting the string-hanging buckling hook 45.

The front of the necktie-knot ring 4 is the most important area for effects and has the options of effects from simple screen printing, hollowing, intertwining and relief to inlaid of precious jewels and diamonds. The string-hanging buckling hook 45 and the rear shell 42 form the back of the necktie-knot ring, which has smooth arc lines taken consideration from the engineering science of human bodies to offer comfort and attractiveness.

The combination of the necktie-knot ring and the necktie of the invention is just like icing on a cake. Its actions and effects are just like a finger ring for a soft finger, a necklace for a pretty neck, a bracelet for a graceful wrist, an earring for a beautiful ear. It adds to fashionable products and the catalogue of jewelry, and further enriches and beautifies the images and lives of people.

The usage of the additional string-hanging strip in a necktie (also a cravat or a scarf) of the invention solves the embarrassments of the necktie flapping around.

Although the above content discloses the invention in detail, the invention is not restricted by the disclosure, and any technical personnel in the technical field can make various changes according to the principle of the invention. Therefore, all the changes made according to the principle of the invention should be interpreted to be within the protective scope of the invention.

I claim:

1. A necktie and necktie-knot device, comprising:

a necktie; and a necktie-knot ring, which is used for forming the necktie knot of the necktie and wherein the necktie-knot ring further comprises:

a necktie-knot ring cavity, which is surrounded by a front shell and a rear shell of the necktie-knot ring and is used for enclosing the necktie;

a necktie inlet-outlet opening, which is positioned on the rear shell and the necktie passes from a top to a bottom of the rear shell;

a necktie fixing device, which is installed on the rear shell; and a shirt-tie connecting strip is arranged at a lower end of a middle part of the necktie, and the shirt-tie connecting strip is sewn on a back or a middle seam of the necktie and is provided with a plurality of button holes;

wherein the fixing device comprises: a through slot which opens on the rear shell; and a sliding buckle which is installed on the through slot, the sliding buckle slides upwards and downwards in the through slot, when the sliding buckle moves downwards, the necktie plugged in the necktie-knot ring cavity is clamped.

2. The necktie and necktie-knot device of claim 1, wherein crinkle dividing teeth for forming double-peak crinkles of the necktie are arranged on an inner side wall of the front shell.

3. The necktie and necktie-knot device of claim 1, wherein the necktie-knot ring has a wide upper part and a narrow lower part.

4. The necktie and necktie-knot device of claim 1, wherein the front shell is backwards concave at its two waists and is forwards convex in the middle.

5. The necktie and necktie-knot device of claim 1, wherein the through slot and the sliding buckle are located at a same side of the necktie inlet-outlet opening.

6. The necktie and necktie-knot device of claim 1, wherein the sliding buckle slides in the through slot along a longitudinal direction.

* * * * *